US007731080B2

(12) United States Patent
Zacher et al.

(10) Patent No.: US 7,731,080 B2
(45) Date of Patent: Jun. 8, 2010

(54) ANTI-SIFTING POLYGONAL CARTON

(75) Inventors: Raymond L. Zacher, West Chester, OH (US); Allen M. Brandenburger, Decatur, GA (US); Craig W. Buscema, Douglasville, GA (US)

(73) Assignee: Graphic Packaging International, Inc., Marietta, GA (US)

( * ) Notice: Subject to any disclaimer, the term of this patent is extended or adjusted under 35 U.S.C. 154(b) by 694 days.

(21) Appl. No.: 11/347,915

(22) Filed: Feb. 6, 2006

(65) Prior Publication Data

US 2006/0180642 A1 Aug. 17, 2006

Related U.S. Application Data

(60) Provisional application No. 60/652,598, filed on Feb. 14, 2005.

(51) Int. Cl.
*B65D 5/00* (2006.01)

(52) U.S. Cl. ..... 229/109; 229/227

(58) Field of Classification Search ..... 229/109, 229/108, 200, 204, 207, 227; 206/822
See application file for complete search history.

(56) References Cited

U.S. PATENT DOCUMENTS 1,425,549 A 8/1922 Scruby
1,892,715 A 1/1933 Wellman
2,565,188 A 8/1951 Weishenbach
2,787,408 A 4/1957 Andre
3,844,088 A 10/1974 McDonough et al.
3,907,194 A * 9/1975 Davenport et al. ..... 229/109
3,944,072 A 3/1976 Budlington et al.
3,990,210 A 11/1976 McDonough et al.
4,084,693 A 4/1978 Culpepper
4,094,124 A 6/1978 Ljungcrantz
4,119,266 A 10/1978 Dempster
4,225,078 A * 9/1980 Croley ..... 229/109
4,260,100 A 4/1981 Hoffman
4,360,146 A 11/1982 Koltz
4,361,267 A 11/1982 Wozniacki
4,392,607 A 7/1983 Perkins, Jr.
4,448,008 A 5/1984 Pankratz et al.
4,470,540 A 9/1984 Koltz
4,702,408 A 10/1987 Powlenko
4,944,405 A 7/1990 Buford et al.
4,984,734 A 1/1991 Zion et al.
5,366,141 A * 11/1994 Stone ..... 229/120.03

(Continued)

*Primary Examiner*—Nathan J Newhouse
*Assistant Examiner*—Christopher Demeree
(74) *Attorney, Agent, or Firm*—Womble Carlyle Sandridge & Rice, PLLC

(57) ABSTRACT

An anti-sifting polygonal carton stores granulated and powdered products. The carton starts as a single blank with four sections: a side, a front, a side, and a rear. The sides have a side panel with two flanking miter panels and two minor flaps. Each miter panel has two opposite miter flaps with embossing. The front has a front panel with a second major flap having a tear strip and an opposite second major lower flap having a crease. Separated from the front by a side, the rear has a rear panel having a miter tab opposite the side and a first major flap and an opposite first major lower flap. The fold lines continuous with the miter flaps and the miter tab are reinforced with tape or patches. The tear strip and top of the carton have a pattern of cuts to open and to reclose the carton.

21 Claims, 6 Drawing Sheets

U.S. PATENT DOCUMENTS 5,531,375 A * 7/1996 Palm ..... 229/137
5,630,543 A 5/1997 Dugan
5,704,540 A 1/1998 Coalier et al.
5,752,648 A 5/1998 Quaintance
5,878,946 A 3/1999 Frerot et al.
5,938,108 A 8/1999 Williams et al.
5,941,452 A * 8/1999 Williams et al. ..... 229/109
5,943,840 A 8/1999 Nilsson et al.
6,042,527 A 3/2000 Anderson et al.
6,202,920 B1 3/2001 Auclair
6,446,859 B1 9/2002 Holladay
6,471,102 B2 10/2002 Hancock
6,588,651 B2 7/2003 Quaintance
6,783,058 B2 8/2004 Quaintance
6,932,266 B2 8/2005 Jones et al.
2005/0263573 A1 12/2005 Goglio
2005/0284922 A1 12/2005 Feltz
2006/0027638 A1 2/2006 Jones et al.
2006/0169755 A1 8/2006 Spivey, Sr.
2007/0063002 A1 3/2007 Zacher et al.

* cited by examiner

ANTI-SIFTING POLYGONAL CARTON

CROSS REFERENCE TO RELATED APPLICATION

This nonprovisional patent application claims priority to the provisional patent application having Ser. No. 60/652,598, filed Feb. 14, 2005.

BACKGROUND OF THE INVENTION

The anti-sifting polygonal carton relates to bulk product packages in general and more specifically to granular detergent or other material packaging. Adhesive or anti-sift tape upon the reverse side of the carton and miter panels seal the corners of the polygonal carton in the bottom and the top. The polygonal carton, when folded and glued upon the bottom, receives product in the main compartment and then the top is folded and glued to seal the carton for shipping.

Carton designs include both partial and full seal end constructions. Traditional cartons have packaged many bulk granular products such as laundry and dishwashing detergents, rice, cereals, pet litter, and dry pet foods. Upon moisture reaching these bulk granular products, the product activates as in detergents or deteriorates as in foods and pet products. Dry bulk products require a moisture resistant and sealed carton. A carton must prevent direct contact of the bulk product with moisture as in water and indirect contact as in humidity. Dry bulk products must meet customer expectations and reduce the losses encountered by bulk product distributors.

Further, cartons must minimize sifting of product out of the carton. Beginning as a blank, cartons start as a continuous plane or blank of material such as paperboard. Upon folding, stress points arise in the blank at each fold and particularly at each corner. Rectangular shaped cartons suffer from many instances of sifting. The corners endure stress from folding on two axes. In shipping and handling, cartons wear down their corners and in time, release the product inadvertently, commonly called sifting.

The present invention provides an octagonal shaped carton that contains bulk granulated product while minimizing sifting. Traditionally, cartons are folded and erected into a generally rectangular finished shape. The present invention utilizes a carton formed by specialized machinery that erects a carton and securely seals the end flaps.

DESCRIPTION OF THE PRIOR ART

Containers, or cartons, for bulk, or granulated, products are known in the prior art. Older cartons held the granulated products within octagonal shapes such as some with gussets. However, tape reinforced folds and corners make few appearances in the prior art.

The patent to Wellman, U.S. Pat. No. 1,892,715, shows a receptacle in its blank from. The receptacle contains a multitude of side walls that overlap, when glued, into the configuration of an octagonal shaped carton. In addition, the carton contains an integral bottom wall and likewise has a top closure, when folded into its usable configuration.

The patent to André, U.S. Pat. No. 2,787,408, is upon a quick set up folding container, bag like and hexagonal in shape.

The patent to McDonough, et al., U.S. Pat. No. 3,844,088, shows machinery for folding and packaging containers, in conjunction with the use of specialized machinery.

The patent to Budington, et al., U.S. Pat. No. 3,944,072, shows an octagonal dispenser carton for band saw coils. This carton just forms an octagonal shape, apparently of a shallow dimension.

Another patent to McDonough, et al., U.S. Pat. No. 3,990,210, shows a very similar mandrel formed carton which is a divisional patent of the previous McDonough patent.

The patent to Ljungcranzt, U.S. Pat. No. 4,094,124, shows a process and apparatus for the manufacture of filled closed containers. The apparatus incorporates a mandrel for shaping a blank, into the carton, during its erection, and filling.

The patent to Koltz, U.S. Pat. No. 4,360,146, shows an open top set-up container. This container forms into a uniquely multi-sided container, somewhat cone shaped, with a bottom, but has an open top.

The patent to Pankratz, et al., U.S. Pat. No. 4,448,008, shows another multiple mandrel carton erecting, filling and sealing machine with two stage loading.

The other patent to Koltz, U.S. Pat. No. 4,470,540, shows another open top set up container with a uniquely shaped, albeit octagonal, form and a uniquely folded bottom.

The patent to Zion, et al., U.S. Pat. No. 4,984,734, shows a stackable articulated carton tray apparatus. This carton simply discloses a shallow octagonal shaped carton, more than likely for holding pizzas.

The patent to Scruby, U.S. Pat. No. 1,425,549, discloses a symmetrical octagonal carton, formed as a paperboard box for containing hats and other millinery products. Nevertheless, a variety of side panels form the octagonal shape and the bottom panels fold over to provide closure. The upper panels incorporate a pair of major flaps, miter end flaps, and miter flaps, arranged intermediate thereof, which are folded over to accommodate an overlying relationship with the major and miter flaps, and adhered thereto for closure.

The patent to Welshenbach, U.S. Pat. No. 2,565,188, shows another polygonal box, an octagon. Likewise, it includes a variety of flaps, functioning as major flaps, with a series of miter flaps, which interlock with the major flaps during closure. Hence, while this patent may show an octagonal box, its various flaps are structured differently when closing.

The patent to Dempster, U.S. Pat. No. 4,119,266, discloses an octagonal shaped paperboard bin. But, all the claims of this patent define the use of slotted flaps for retention of the top of the carton.

The patent to Croley, U.S. Pat. No. 4,225,078, discloses a knocked-down polygonal container with set-up contour-forming flaps. This particular container apparently is opened upon its top, while its bottom includes a series of flaps that fold inwardly and form a bottom closure.

The patent to Hoffman, U.S. Pat. No. 4,260,100, shows another container closure with a series of end flaps pivotally connected to the sides of the outer closure panels to close the top of the carton. The tuck-in flaps tuck into the carton, rather than providing any type of a miter support for the erected carton.

The patent to Wozniacki, U.S. Pat. No. 4,361,267, shows a four corner design for an octagonal container and the corner flaps really provide an engagement flap, for tuck-in purposes, to secure the shown container into closure.

The patent to Perkins, Jr., U.S. Pat. No. 4,392,607, shows a carton with integral closures that forms an octagonal shape and overlapping of its various top miter flaps to engage with the flap strips.

The patent to Powlenko, U.S. Pat. No. 4,702,408, shows a bulk bin formed into an octagonal shape designed for the shipment of heavy quantities of fresh meat. It does not appear that any particular style of top closure has been made for this bin, and its bottom closure incorporates a variety of flaps that tuck into each other.

The patent to Dugan, U.S. Pat. No. 5,630,543, shows another one-piece octagonal box, a bulk bin box, but its closure and folding flaps have more of the bellows style of closure. The claims define the specific structure of its blank, as a unitary piece of cardboard that is folded into the octagonal shape, that the bottom of the box is formed of a pair of tabs, incorporating slots, with each tabbed slot simultaneously and continuously intermeshing with the other tab that helps erect the carton when they are opened.

The patent to Holladay, U.S. Pat. No. 6,446,859, shows another foldable storage container, an octagonal box. The upper closure is more designed for forming a recessed closure, than of the present invention. The claims of this particular patent define lid panels, sized to fit within the polygonal folded sheets.

The patent to Vogel, U.S. Pat. No. 6,471,102, is upon an easy opening handled carton, more concerned with its tear strip, which when opened, provides for a central portion of the major panel to be pulled free. In the carton, though, the bottom and top require the top units and bottom units to be attached to the inner surface of the walls unlike the present invention.

The patent to Quaintance, U.S. Pat. No. 6,588,651, discloses an octagonal bulk bin. The claims of this patent define score lines in at least one of the side walls for the bin. The score lines are weakened to buckle the wall in a controlled manner unlike the present invention.

The patent to Coalier, et al., U.S. Pat. No. 5,704,540, discloses a carton or cover with rigid sheet material and a handle. The carton folds into an octagonal shape but the claims of this patent define an elongated handle used in conjunction with the carton, unlike the present invention.

The patent to Frerot, et al., U.S. Pat. No. 5,878,946, shows a carton or cover of rigid sheet material with a reinforced handle, blank and process for manufacturing the same. The carton, when formed, does have somewhat of an octagonal shape.

The patent U.S. Pat. No. 5,943,840, to Nilsson, et al., is upon a method and apparatus for forming a top of a container. In essence though, the carton assembled upon the multi-mandrel machine appears more rectangular, and which is formed upon the various mandrel machinery in a continuous operation.

The patent to Anderson, et al., U.S. Pat. No. 6,042,527, is upon another carton forming device. The claims of this particular patent define the apparatus for forming the blank into an erect carton: a standard rectangular carton.

The patent to Auclair, U.S. Pat. No. 6,202,920, is upon another carton blank. It is apparently a gusseted carton, using its end formation, including all of its gussets and apparently undertakes the shape of its top panels, which are octagonal.

While the above-described devices fulfill their respective, particular objectives and requirements, the aforementioned patents do not describe an anti-sifting polygonal carton with little forming, sifting, and sealing problems. Therefore, a need exists for a new and improved polygonal carton that can be formed upon specialized machinery, for accurate folding and sealing of one end of the carton. In this regard, the present invention substantially fulfills this need. Further, the polygonal carton according to the present invention substantially departs from the conventional concepts and designs of the prior art, and in doing so provides a device primarily developed for the purpose of sealing and reinforcing carton corners to reduce sifting of granulated products from cartons.

SUMMARY OF THE INVENTION

Generally, the present invention provides a single piece bulk granular product carton. The carton comprises a blank with major flaps, lower major flaps, minor flaps, miter flaps, emboss pads, a front panel, a rear panel, miter panels, notches, reinforcing tape, and a tear strip. The panels form a polygonal such as an octagon shaped carton with the flaps for closing the ends of the carton. The flaps overlap to seal the four corners of each end. With sealed ends, the carton reduces sifting and other losses of granulated product from within the carton.

The polygonal carton addresses the sifting problem with a combination of minor flaps, emboss pads, and offset scores in various locations. Upon forming the carton, the minor flaps and then the miter panels are folded by intricate machinery that then applies glue to form a seal between the miter panels and the minor flaps. Next, upon forming the first major flap and the second major flap, emboss pads on the miter flaps fill the gap at the edge of the minor flaps and the first and second major flaps. Any remaining space in the miter flap is filled by glue. Without offset scores on the miter flaps, the carton has a closer more air-tight seal. Further, pinhole gaps have less effect as each miter, front and rear, and side panel folds at 45 degrees to form the octagonal carton. All minor panels have a tight overlap that avoids stress and fiber tear at the corners. An emboss pad on the second major lower flap fills the gap created by the partial overlap of the first major lower flap when sealing the bottom of the carton.

Preferably, the anti-sifting polygonal carton is a paperboard container of a single blank of material that forms an eight sided carton. The carton includes trapezoidal minor flaps with triangular emboss pads upon four miter panels, two side panels with attached minor flaps, and front and back panels with attached major flaps. The major flaps then allow opening and re-closing of the top, when initiated by a tear strip opener.

The present invention forms upon specialized machinery that allows gluing of the side seam. Gluing occurs as machinery first forms the blank into a tube as the precursor to a carton. The bottom of the carton then forms as the miter flaps fold beneath the minor flaps, glue then applied seals the bottom. After gluing the minor flaps, the specialized machinery folds the first major lower flap and glues it to the minor flaps layered upon the miter flaps. The second major flap then folds and glues upon the first major flap to form and seal the bottom of the carton. After insertion of the granulated product into the open carton, the second major flap is folded upon the first major flap as the top of the carton. The carton is now ready for shipping and sale to consumers.

Numerous objects, features and advantages of the present invention will be readily apparent to those of ordinary skill in the art upon a reading of the following detailed description of presently preferred, but nonetheless illustrative, embodiment of the present invention when taken in conjunction with the accompanying drawings. Before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, the phraseology and terminology employed herein are for the purpose of description and should not be regarded as limiting.

One object of the present invention is to provide a new and improved polygonal carton that contains granulated product without sifting.

Another object is to provide such a carton that has tape reinforced corners.

Another object is to provide such a carton that is octagonal in shape that differentiates the carton from other manufactures in the eyes of the consumer.

Another object is to provide such a carton that is formed upon specialized machinery for accuracy of folding and integrity of sealing.

Another object is to provide such a carton that has a higher vertical load capacity, or top load compression strength, than rectangular cartons allowing for higher stacking of cartons at warehouses.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated a preferred embodiment of the invention.

BRIEF DESCRIPTION OF THE DRAWINGS

The same reference numerals refer to the same parts throughout the various figures.

DESCRIPTION OF THE PREFERRED EMBODIMENT

Figure 1:
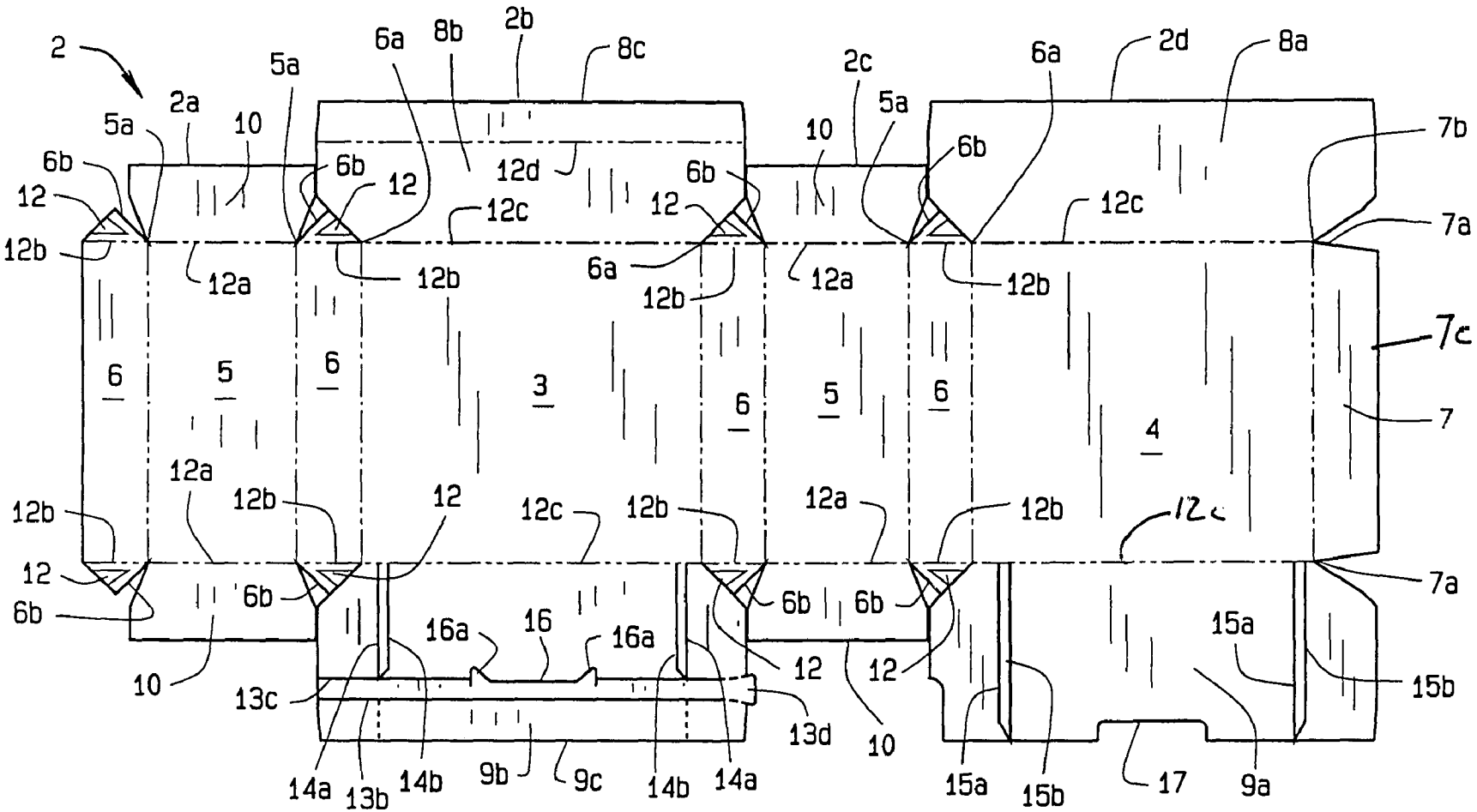
FIG. 1 shows a plan view of the reverse face of a blank of the preferred embodiment of the anti-sifting polygonal carton assembled in accordance with the principles of the present invention.

The present art overcomes the prior art limitations and sifting of granulated product by reinforced tape, miter panels, and emboss pads at the four minor corners of the present invention. Beginning on FIG. 1, the preferred embodiment of the anti-sifting polygonal carton 1 starts as a flat blank 2 of somewhat H shape, generally symmetric, with four contiguous sections. The sections run side 2*a*, front 2*b*, side 2*c*, and rear 2*d*. Each side section 2*a* includes two miter panels 6 and the rear section 2*d* includes notches 7*a* and a separate miter tab 7.

The first section 2*a*, or side panel 5, extends outward from the center of the blank 2 along the longitudinal axis of the blank 2. A side panel 5 has a generally rectangular shape with the longitudinal axis of the side panel 5 perpendicular to the longitudinal axis of the blank 2. The length of the side panel 5 establishes the general height of the finished carton 1. The side panel 5 has longitudinal creases 5*a* and lateral folds 12*a* of lesser length than the longitudinal creases 5*a*. Extending away from the lateral folds 12*a* upon both ends, minor flaps 10 have a generally trapezoidal shape with a short base and a spaced apart parallel long base with edges joining the two bases. The short base is contiguous with the side panel 5 at a lateral end along a fold line 12*a*. Upon one or both edges, a minor flap 10 contacts a major flap or a major lower flap.

Flanking the side panel 5, miter panels 6 join the longitudinal creases 5*a* of the side panel 5. The longitudinal axes of the miter panels 6 are parallel to the longitudinal axis of the side panel 5. The miter panels 6 have a generally rectangular shape of less than or equal to half the width of a side panel 5. The miter panels 6 also have lateral folds 12*b* and longitudinal creases 6*a*. The lateral folds 12*b* connect miter flaps 6*b* with the miter panels 6. The miter flaps 6*b* have a generally triangular shape with the base of the triangle upon the fold 12*b* and the vertex of the triangle away from the miter panel 6. Each end of a miter panel 6 has a miter flap 6*b*. The miter flaps 6*b* are cut separate from the minor flaps 10 but contact the major and major lower flaps. Each miter flap 6*b* has an emboss pad 12 raised upon the obverse face of the blank 2. The emboss pad 12 also has a generally triangular shape though of less size than the miter flap 6*b*. The emboss pad 12 triangle has its base towards the fold 12*b* and its point away from the fold.

Away from the first section 2*a* towards the center of the blank 2, the second section 2*b* has the front panel 3 and appended second major flap 9*b* and second major lower flap 8*b*. The front panel 3 has a generally rectangular shape with a longitudinal axis parallel to the longitudinal axis of the blank 2. The front panel 3 has lateral ends contiguous with creases 6*a* to the miter panels 6 and longitudinal sides contiguous with folds 12*c* to the second major flap 9*b* and the second major lower flap 8*b*.

The second major flap 9*b* has a generally trapezoidal shape with a short base and a spaced apart and parallel long base joined by edges. The short base is contiguous with a fold 12*c* upon the longitudinal side of the front panel 3. The long base is away from the center of the blank 2, or towards the center of the assembled invention. The edges have a straight shape with an end proximate to the short base truncated at an approximately 45° angle. The miter flaps 6*b*7 abut the second major flap 9*b* at the truncated edges. Proximate to the long base, the second major flap 9*b* has a tear strip 13.

Parallel and spaced apart from the long base, the tear strip 13 allows a consumer to open the assembled invention. The tear strip 13 has a thin line of tape 13*a* upon the reverse side for ripping strength. The tear strip 13 forms from the second major flap 9*b* with partial cuts 13*b, c*. The first partial cut 13*b*, away from the center of the blank 2, extends for the length of the second major flap 9*b*. The second partial cut 13*c*, spaced apart and parallel to the first partial cut 13*b*, extends for two portions of the second major flap 9*b*. The second partial cut 13*c* has two triangular shaped ears 16*a* and a center portion 16*b*, with the vertex of the triangle shape towards the center of the blank 2. Upon removal of the tear strip 13, the ears 16*a* and center portion 16*b* form a male tab 16 to re-close the carton 1. Both the first and second partial cuts 13*b, c* expand outwards at a taper near the right side of the carton 1. The wider width of the tear strip 13 allows for a person to grip the strip 13.

The second major flap 9*b* also has additional cuts 14*a, b*, perpendicular to the tear strip 13. The third partial cut 14*a*, or outside cut is near the miter corner and extends across the width of the second major flap 9*b*. The outside cut 14*a* extends through the depth of the blank 2 but does not penetrate the reverse face of the blank 2. Parallel and inward of the outside cut, the fourth partial cut 14*b*, or inside cut, extends from the fold to the second partial cut. Akin to the outside cut, the inside cut 14*b* penetrates the blank 2 but not the reverse face.

Opposite the second major flap 9*b*, the second section 2*b* has the second major lower flap 8*b*. The second major lower flap 8*b* has a generally trapezoidal shape with a short base and a spaced apart and parallel long base joined by edges. The short base is contiguous with a fold 12*c* upon the longitudinal side of the front panel 3. The long base is away from the center of the blank 2, or towards the center of the assembled invention. The edges have a taper with an end proximate to the short base truncated at an approximately 45 degree angle. The miter flaps 6*b* abut the second major lower flap 8*b* at the truncated edges. Proximate to the long base, the second major lower flap 8*b* has a crease 12*d*. The crease 12*d* extends parallel to the long base and overlaps the long base of the first major lower flap 8*a*. The crease 12*d* permits the second major lower flap 8*b* to bend over the first major lower flap 8*a* forming the sealed bottom 8 of the carton 1.

Contiguous with the front panel 3 and opposite the first section 2*a*, the third section 2*c* has a similar assembly as the first section 2*a*. The third section 2*c*, or side panel 5, extends outward from the center of the blank 2 along the longitudinal axis of the blank 2. This side panel 5 has a generally rectangular shape with the longitudinal axis of the side panel 5 perpendicular to the longitudinal axis of the blank 2. As in the first section 2*a*, the length of this side panel 5 establishes the general height of the finished carton 1. The side panel 5 has longitudinal creases 5*a* and lateral folds 12*a* of lesser length than the longitudinal creases 5*a*. Extending away from the lateral folds 12*a* upon both ends, minor flaps 10 have a generally trapezoidal shape with a short base and a spaced apart parallel long base with edges joining the two bases. The short base is contiguous with the side panel 5 at a lateral end along a fold line 12*a*. Upon both edges, the minor flap 10 contacts a major and major lower flap.

Flanking the side panel 5, miter panels 6 join the longitudinal creases 5*a* of the side panel 5. The longitudinal axes of the miter panels 6 are parallel to the longitudinal axis of the side panel 5. The miter panels 6 have a generally rectangular shape of less than or equal to half the width of a side panel 5. The miter panels 6 also have lateral folds 12*b* and longitudinal creases 5*a*. The lateral folds 12*b* connect the miter flaps 6*b* with the miter panels 6. The miter flaps 6*b* have a generally triangular shape with the base of the triangle upon the fold and the vertex of the triangle away from the miter panel 6. Each end of a miter panel 6 has a miter flap 6*b*. The miter flaps 6*b* are cut separate from the minor flaps 10 but contact the major and major lower flaps. Each miter flap 6*b* has an emboss pad 12 raised upon the obverse face of the blank 2. The emboss pad 12 also has a generally triangular shape though of less size than the miter flap 6*b*. The emboss pad 12 triangle has its base towards the fold and its point away from the fold.

And contiguous with the third section 2*c*, or side panel 5, the fourth section 2*d* has the rear panel 4 and appended first major flap 9*a*, first major lower flap 8*a*, and miter tab 7. The rear panel 4 has a generally rectangular shape with a longitudinal axis parallel to the longitudinal axis of the blank 2. The rear panel 4 has lateral ends contiguous with creases 6*a*, 7*b* to a miter panel 6 and the miter tab 7 and longitudinal sides contiguous with folds 12*c* to the major flap 9*a* and the major lower flap 8*a*.

The first major flap 9*a* has a generally trapezoidal shape with a short base and a spaced apart and parallel long base joined by edges. The short base is contiguous with a fold 12*c* upon the longitudinal side of the rear panel 4. The long base is away from the center of the blank 2, or towards the center of the assembled invention. The edges have a straight shape with an end proximate to the short base truncated at an approximately 45° angle. A miter flap 6*b* abuts the second major flap 9*b* at the truncated edge nearer the center of the blank 2. Upon the long base, the first major flap 9*a* has a rectangular notch 17.

As described previously for the second major flap 9*b*, upon removal of the tear strip 13, ears 16*a* and center portion 16*b* form a male tab 16. The male tab 16 fits the female notch 17 upon the long base of the first major flap 9*a*. The male tab 16 within the female notch 17 closes the top 9 of the carton 1. In blank form 2, the first and second major flaps 9*a, b* have the same width.

The first major flap 9*a* has cuts 15*a, b*, perpendicular to the fold 12*c*. The first partial cuts 15*a*, or outside cuts, are near the miter corners and extend across the width of the first major flap 9*a*. The outside cuts 15*a* extend through the depth of the blank 2 but do not penetrate the reverse face of the blank 2. Parallel and inward of the outside cut, the second partial cuts 15*b*, or inside cut, extend from the fold 12*c* to near the long base. Akin to the outside cut, the inside cuts 15*b* penetrate the blank 2 but not the reverse face.

Opposite the first major flap 9*a*, the fourth section 2*d* has the first major lower flap 8*a*. The first major lower flap 8*a* has a generally trapezoidal shape with a short base and a spaced apart and parallel long base joined by edges. The short base is contiguous with a fold upon the longitudinal side of the front panel 3. The long base is away from the center of the blank 2, or towards the center of the assembled invention. The edges have a taper with an end proximate to the short base truncated at an approximately 45 degree angle. A miter flap 6*b* abuts the first major lower flap 8*a* at a truncated edge. Opposite the miter panel 6 of the third section 2*c*, the fourth section 2*d* has a miter tab 7 extending from the other lateral end of the rear panel 4. The miter tab 7 has the same width as a miter panel 6 and slight trapezoidal shape. The long base of this trapezoid is a crease 7*b* to the rear panel 4 and the short base, spaced apart and parallel, to the long base is free for later attachment to the first section 2*a* during assembly of the carton 1. Unlike other miter panels 6, the miter tab 7 lacks miter flaps 6*b*. The edges of this trapezoidal shape have a slight taper, narrowing away from the center of the blank 2 forming notches 7*a*. The foregoing has described the anti-sifting polygonal carton 1 and its shape in blank 2 form viewing the reverse face.

Figure 1A:
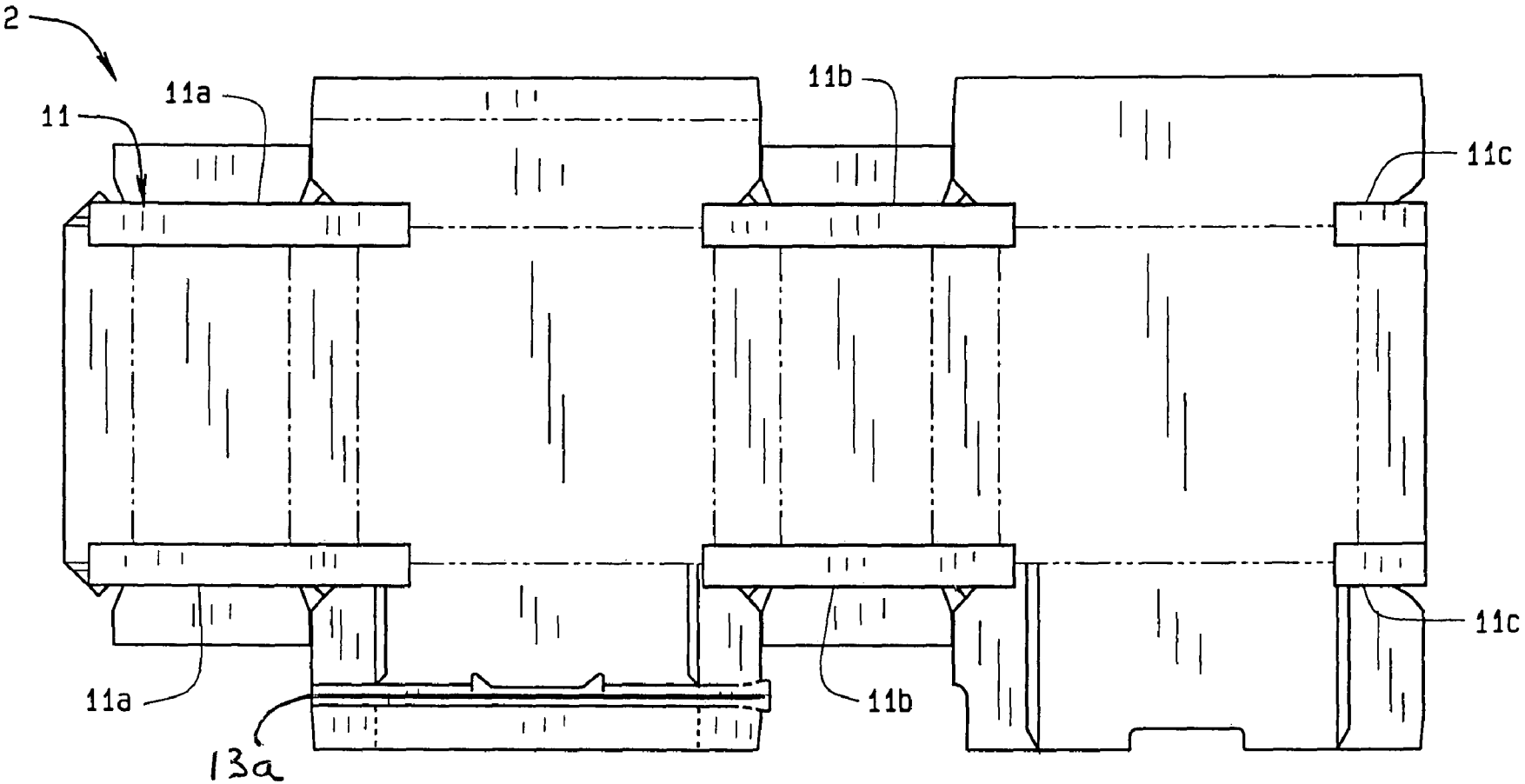
FIG. 1A illustrates the anti-sift tape upon the reverse face of the present invention.

Turning to FIG. 1A, the present invention has pieces of tape 11 or adhesive patches located on the reverse face of the blank 2, along the folds 7*a*, 12*a, b, c* contiguous with the miter panels 6 and the miter tab 7. The pieces of tape 11 or adhesive patches have a generally rectangular shape, width of approximately one inch, and symmetric arrangement. The patch 11*a* extends across the folds 12*a, b* of the first section 2*a* and somewhat upon the folds 12*c* of the second major flap 9*b* and second lower major flap 8*b*. The patch 11*b* then applies to the third section 2*c* and extends somewhat upon the folds 12*c* of both the second major flap 9*b* and second lower major flap 8*b*, and the major flap 9*a* and the lower major flap 8*a*. Lastly, the patch 11*c* or patch applies to the edges of the miter tab 7 and somewhat back into the folds 12*c* of the major flap 9*a* and the lower major flap 8*a*. The reinforcing tape 11 or patches limit the sifting of product out of corners of the assembled carton 1.

Figure 1B:
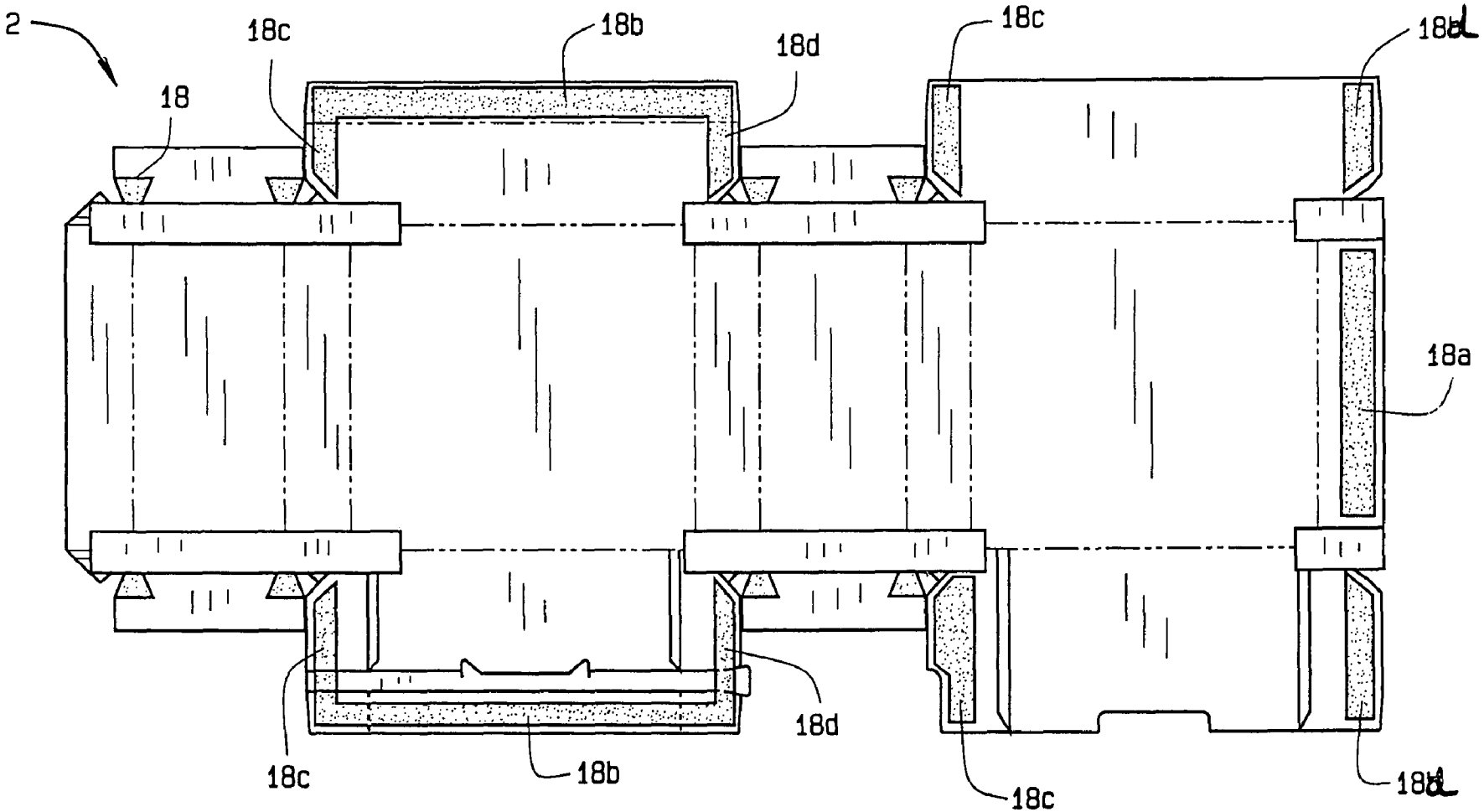
FIG. 1B illustrates the glue applied to the reverse face of the present invention.

Then in FIG. 1B, the reverse face of the blank 2 of the present invention has adhesive applied to seal the bottom 8 and later the top 9 of the carton 1. The reverse face has adhesive applied in a somewhat triangular pattern 18 to each minor flap 10 at each end of the short base. The vertex of the triangular adhesive 18 pattern points towards the intersection of the fold 12*b* and the crease 5*a* for the miter panel 6 while the base of the triangular adhesive 18 pattern extends towards and parallel to the long base of the miter panel 6. The blank 2 has generally eight triangular adhesive 18 patterns.

Away from the miter panels 6, the miter tab 7 has a strip of adhesive 18*a* applied for the full length. The adhesive 18*a* secures the miter tab 7 in the fourth section 2*d* to the miter panel 6 in the first section 2*a* during assembly of the carton 1. Outwards from the miter panel 6, the first major flap 9*a* and the first major lower flap 8*a* have parallel strips of adhesive 18*c, d*. These adhesive 18*c,* d strips occupy both edges of the flaps 8*a,* 9*a* and extend from the long base towards the short base. The adhesive strips 18*c* span from the edge of the flaps inwards to an imaginary line extending from the crease 6*a* and the adhesive strips 18*d* have a generally trapezoidal shape perpendicular to the longitudinal axis of the carton 1. During assembly, the adhesive strips 18*c, d* strips of the first major lower flap 8*a* secure to the lower minor flaps 10. After filling the carton 1 with product, a manufacturer closes the first major flap 9*a* where its adhesive strips 18*c, db* secure to the minor flaps 10.

Further away from the miter flap 6*b,* the second major flap 9*b* and second major lower flap 8*b* have adhesive strips 18*b, c, d*. These strips 18*c,d* run along the long base of both flaps 8*b*, 9*b* and the edges of both flaps 8*b*, 9*b* similar to the edges of the first major flap 9*a* and the first lower major flap 8*a*. The strips 18*d* have a width outside of the tear cuts 14*a, b* and the crease 12*d* in the second major lower flap 8*b*. Along the edges, the adhesive strips 18*c, d* strips again span from the edge of the flaps 9*a, b* inwards to an imaginary line extending from the crease 6*a*. The adhesive strips 18*c, d* have a generally trapezoidal shape perpendicular to the longitudinal axis of the blank 2. During assembly, the adhesive strips 18*b, c, d* of the second major lower flap 8*b* secure to the first major lower flap 8*a*. After filling the carton 1 with product, a manufacturer closes the second major flap 9*b* where its adhesive strips 18*b, c, d* secure to the first major flap 9*a*.

Figure 2:
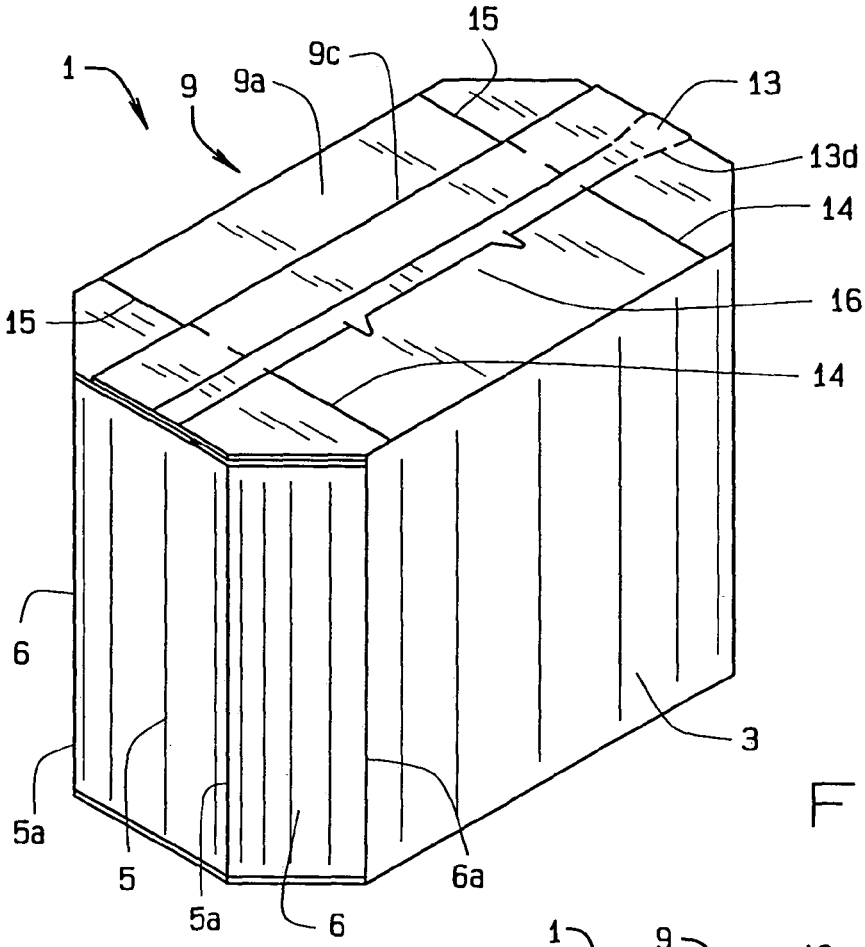
FIG. 2 shows an isometric view of the preferred embodiment of the anti-sifting polygonal carton.

Upon folding the blank 2 with specialized machinery that forms the bottom 8 of the carton 1, filling the carton 1 with product, and closing the second major flap 9*b* upon the first major flap 9*a*, the present invention assembles into a carton 1 shown in an isometric view in FIG. 2. The carton 1 has a front established by the generally rectangular shaped front panel 3 and two flanking miter panels 6. The miter panels 6 extend rearward of the front panel 3 at an approximately 45 degree angle. From the miter panels 6, side panels 5 extend further rearward. The side panels 5 are generally perpendicular to the front panel 3 and have a rectangular shape of lesser width than the front panel 3. Rearward from the side panels 5, two additional miter panels 6 extend at an approximately 45 degree angle towards the rear panel 4. The rear panel 4 is parallel to and spaced apart from the front panel 3. The carton 1 has a generally polygonal shape more particularly an octagonal shape. Generally, the carton 1 is symmetric upon three axes when assembled and closed. Perpendicular to the front panel 3, the carton 1 has a top 9 closed after filling the carton 1 with product. The top 9 comprises the second major flap 9*b* folded upon the first major flap 9*a* with both flaps folded inwards. The tear strip 13 of the second major flap 9*b* remains upon the top 9 for a consumer to use for opening the carton 1.

Figure 3:
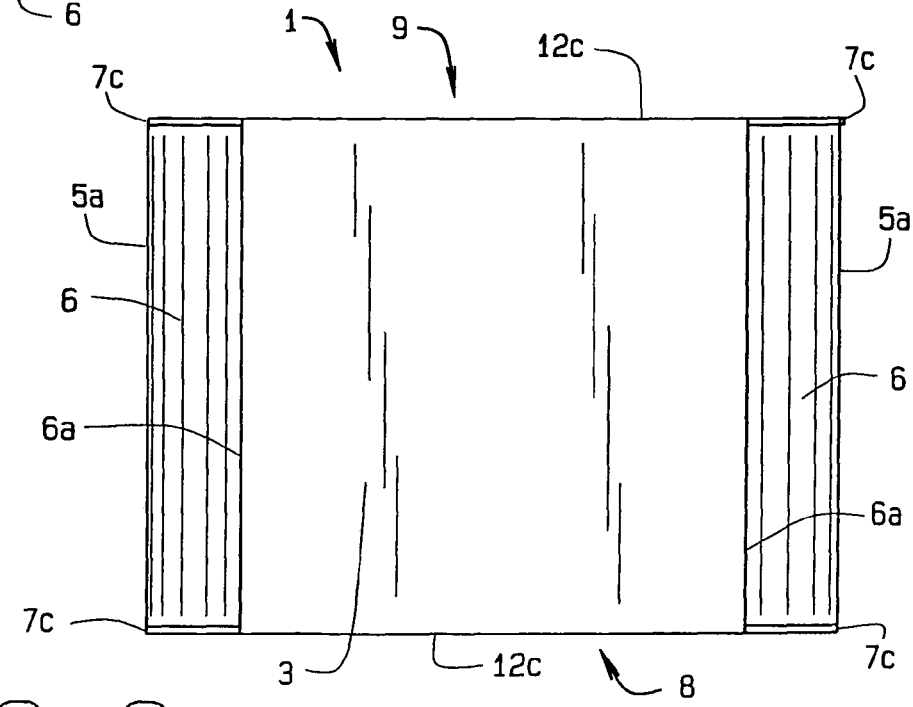
FIG. 3 shows a front view of the present invention.

FIG. 3 shows the front of the carton 1 and the width of the front panel 3 establishes the length of the finished carton 1. The front panel 3 has a generally rectangular shape with two ends perpendicular to the longitudinal axis of the front panel 3. A miter panel 6 extends rearward from each end at a crease 6*a*. At each end, the top 9, and the bottom 8, the carton 1 has gaps 7*c*. In the front, the gaps 7*c* arise when the second major flap 9*b* folds upon the first major flap 9*a* and the second major lower flap 8*b* folds upon the first major lower flap 8*a*. The miter flaps 6*b* extending from the miter panels 6 seal the gaps 7*c* beneath the second major flap 9*b* and the second major lower flap 8*b* as an anti-sifting measure.

Figure 4:
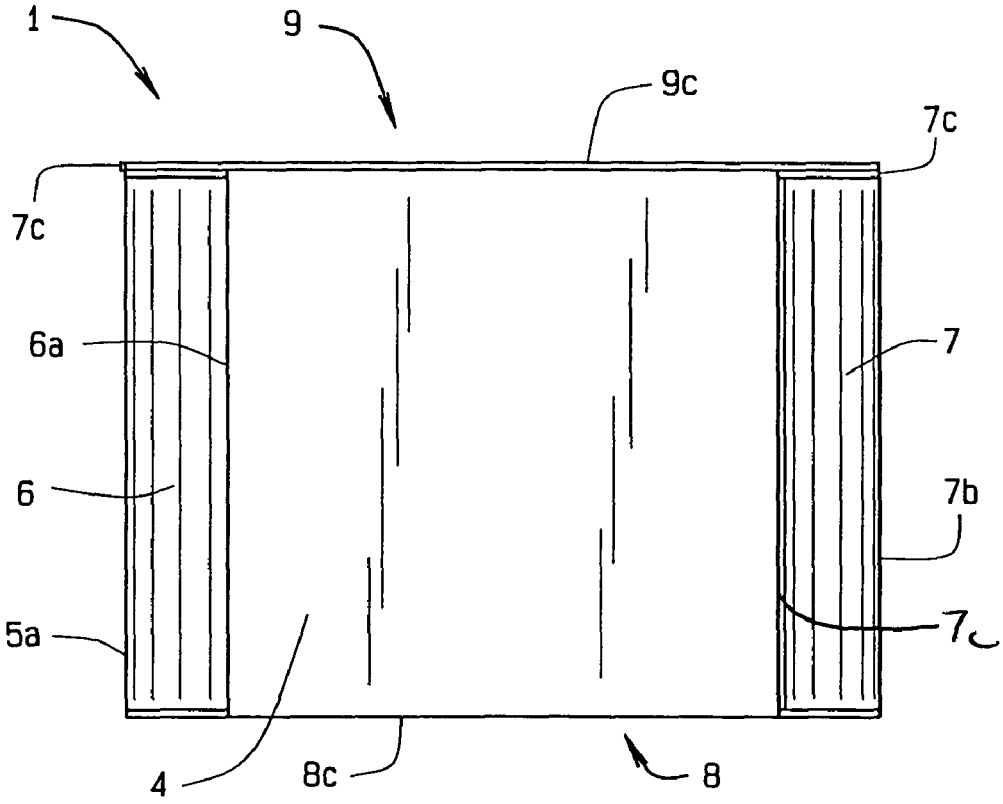
FIG. 4 shows a rear view of the present invention.

Opposite the front, FIG. 4 shows the rear of the carton 1. The rear panel 4 has a generally rectangular shape with two ends perpendicular to the longitudinal axis of the front panel 3. A miter panel 6 extends rearward from each end at a crease 6*a*. Towards the left of the carton 1, the rear panel 4 shows an edge 7*c* where the miter tab 7 secures to a miter panel 6. Towards the top 9 of the carton 1, the second major flap 9*b* shows an edge 9*c* along the length of the carton 1. And towards the bottom 8 of the carton 1, the second major lower flap 8*b* shows an edge also along the length of the carton 1. Then at each end, the top 9, and the bottom 8, the carton 1 has gaps. In the rear, the gaps 7*c* arise when the first major flap 9*a* lies beneath the second major flap 9*b* and the first major lower flap 8*a* lies under the second major lower flap 8*b*. The miter flaps 6*b* extending from the miter panels 6 seal the gaps 7*c* above the first major flap 9*a* and the first major lower flap 8*a* as an anti-sifting measure.

Figure 5:
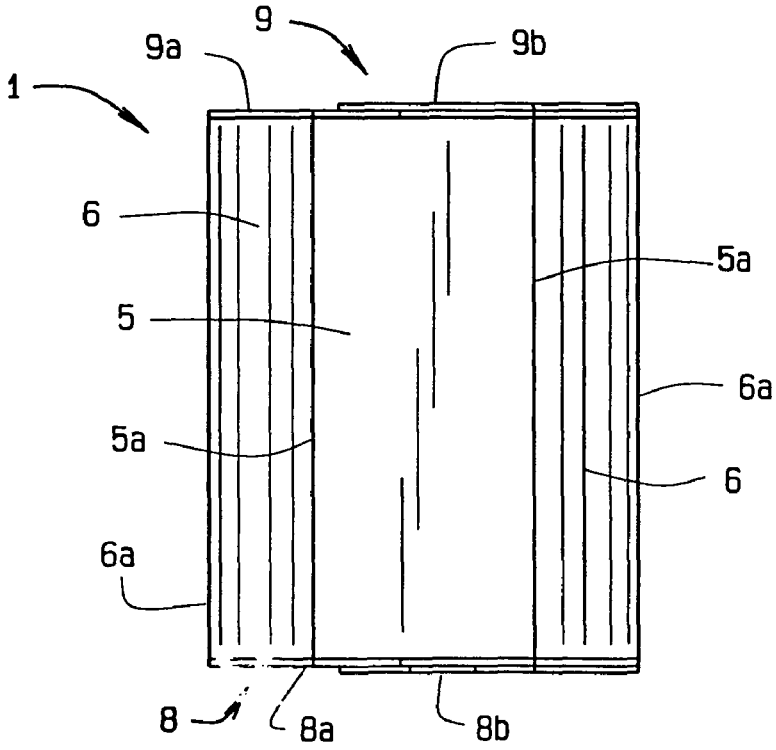
FIG. 5 shows a side view of the present invention.

Turning the present invention, FIG. 5 shows a side of the carton 1. The side has a generally rectangular shape set by the side panel 5 that establishes the height and depth of the carton 1. The side has two longitudinal edges from which extend the miter panels 6 at an approximately 45 degree angle towards the center of the carton 1. The miter panels 6 are narrower than the side panel 5. At the top 9, the filled carton 1 shows the edges of the second major flap 9*b* folded and glued upon the first major flap 9*a*. Then at the bottom 8, the carton 1 shows the second major lower flap 8*b* folded over and glued upon the first major lower flap 8*a*.

Figure 6:
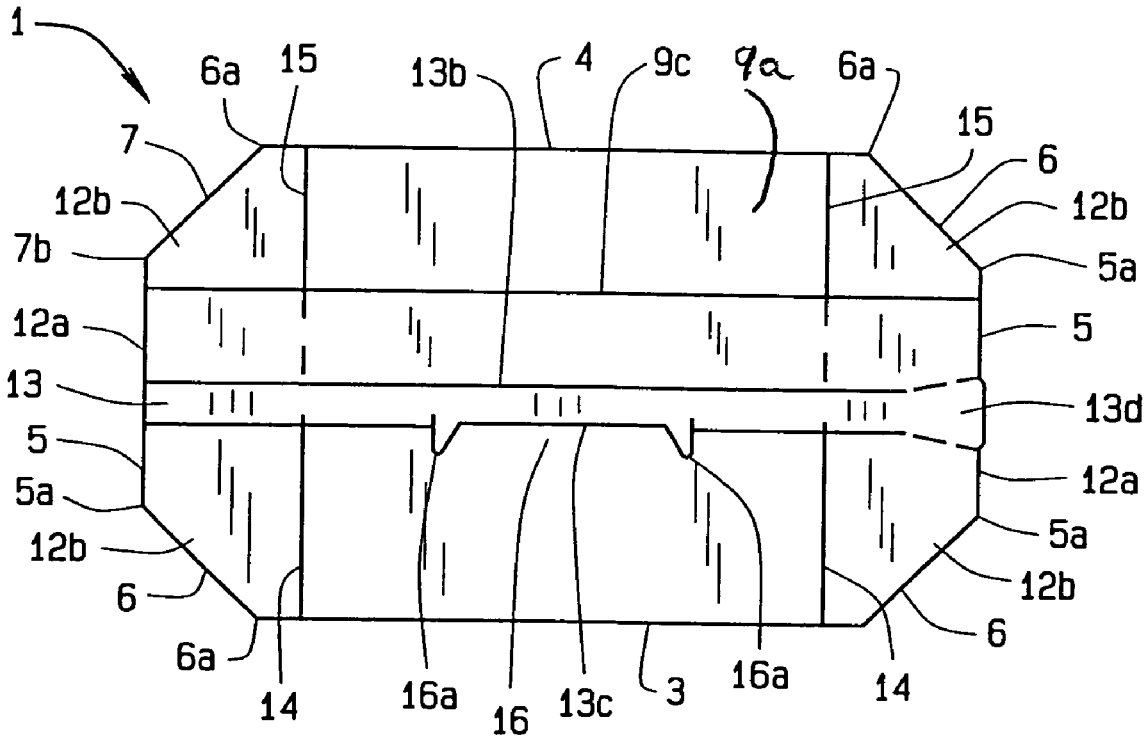
FIG. 6 describes the top view of the present invention.

Seen from above in FIG. 6, the present invention has a top 9 to contain product during shipment and handling, and later to release product. FIG. 6 shows the top 9 sealed. With the front panel 3, side panels 5, and rear panel 4 joined by contiguous miter panels 6 and the miter tab 7, the carton 1 has a generally polygonal, or particularly an octagonal shape. The front panel 3 and the rear panel 4 have the greatest width followed by the side panels 5 and then the miter panels 6 as the narrowest. For the top 9, the second major flap 9*b* folds partially over the first major flap 9*a*, leaving approximately one third of the width of the first major flap 9*a* visible.

As described earlier in FIG. 1, the top 9 has a tear strip 13, parallel and spaced apart from the edge 9*c* of the second major flap 9*b*. The tear strip 13 allows a consumer to open a sealed carton 1 containing product. The tear strip 13 has a thin line of tape 11 upon the reverse face of the second major flap 9*b*. The tear strip 13 forms with partial cuts: the first partial cut 13*b,* towards the edge, extends for the length of the second major flap 9*b,* and the second partial cut 13*c*, spaced apart and parallel to the first partial cut 13*b*, extends for two portions of the second major flap 9*b*. The second partial cut 13*c* has two triangular shaped ears 16*a* and a center portion, with the vertex of the triangle shape towards the center of the blank 2. Upon removal of the tear strip 13, the ears 16*a* and center portion form a male tab 16 to re-close the carton 1. Both the first and second partial cuts 13*b, c* expand outwards at a taper near the right side of the carton 1. The wider width of the tear strip 13 allows for a person's grip.

The top 9 also has additional cuts to open the second and first major flaps 9*a, b* away from the mitered and sealed corners. The second major flap 9*b* has cuts perpendicular to the tear strip 13. The third partial cuts 14*a*, or outside cuts are nearer to the miter panels 6 and extend across the width of the second major flap 9*b*. The outside cuts 14*a* extend through the depth of the blank 2 but do not penetrate the reverse face of the blank 2. Parallel and inward of the outside cuts 14*a*, the fourth partial cuts 14*b*, or inside cuts, extend from the fold to the second partial cut 13*c*. Akin to the outside cuts 14*a*, the inside cuts 14*b* penetrate the blank 2 but not the reverse face.

Beneath the second major flap 9*b*, the first major flap 9*a* has cuts generally collinear with the cuts 14*a, b* upon the second major flap 9*b*. The first partial cuts 15*a*, or outside cuts, are near the miter panels 6 and extend across the width of the first major flap 9*a*. The outside cuts extend through the depth of the blank 2 but do not penetrate the reverse face of the blank 2. Parallel and inward of the outside cu 15*a*, the second partial cuts 15*b*, or inside cuts, extend from the fold to the near the long base. Like the outside cuts 15*a*, the inside cuts 15*b* penetrate the blank 2 but not the reverse face. The cuts 14*a,b* 15*a, b* in the top 9 delineate a rectangular portion of the top 9 for separation from the sealed corners.

Figure 7:
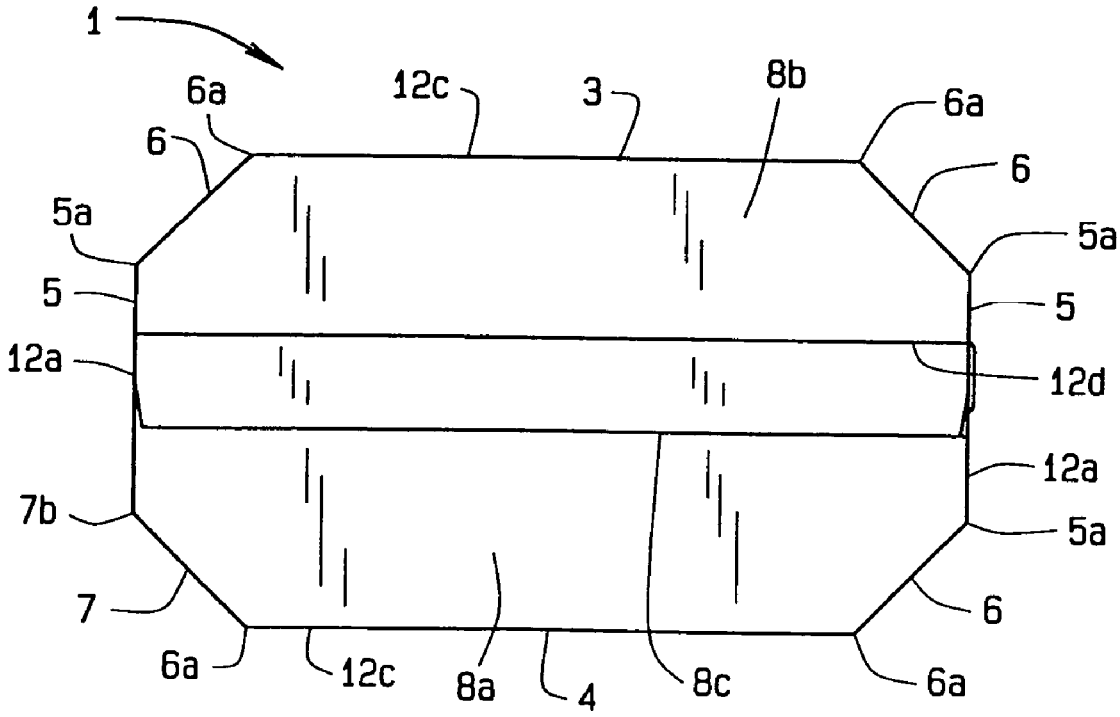
FIG. 7 describes the bottom view of the present invention.

Rotating the present invention, FIG. 7 illustrates the bottom 8 of the anti-sifting polygonal carton 1. As in the top 9, the bottom 8 has a polygonal shape, here an octagon. Within the octagon, the second major lower flap 8*b* overlays the first major lower flap 8*a*. Parallel to the longitudinal axis of the carton 1, the second major lower flap 8*b* has a crease 12*d* that overlaps the long edge of the first major lower flap 8*a*. The crease 12*d* allows the second major lower flap 8*b* to bend over the first major lower flap 8*a* and seal the bottom 8 of the carton 1.

In use, the carton 1 has a unique opening feature started by a tear strip 13. The tear strip 13 has partial knife cuts 13*b, c* backed by tape 11 along the length of the second major flap 9*b*. After pulling and removing the tear strip 13, further opening occurs along partial and full die cuts 14*a, b*, 15*a, b*, as well as perforations. A consumer pulls away the remaining second major flap 9*b*. The hinged connection of the second major flap 9*b* to the carton 1 allows easy separation of the second major flap 9*b* from the remainder of the top 9. Next, a consumer opens the first major flap 9*a* in a similar manner. Both major flaps 9*a, b* rotate about a fold line 12*c* after delaminating from full die cuts 14*a, b*. The full die cuts, extending through the press applied tape 11, cleanly expose the remainder of the major flaps 9*a, b* and the male re-close feature 16. On the second major flap 9*ba*, the partial die cuts 14*a, b* have sufficient depth to cut the press applied tape 11 to open the top 9 along the inside and the outside partial cuts 14*a, b*. The paperboard then delaminates and reveals the granulated product within the carton 1.

To close the carton 1, a consumer rotates the first major flap 9*a* toward the top 9 of the carton 1. The first major flap 9*a* has the female notch 17 while the second major flap 9*b* has the male tab 16. The consumer then rotates the second major flap 9*b* and inserts the male tab 16 into the female notch 17. Pressing gently, the consumer closes the second flap 9*b* upon the first flap 9*a*, and the male tab 16 and female notch 17 interlock. The flaps 9*a, b* now rest upon the top 9 and close the carton 1 until later use by the consumer.

From the aforementioned description, an anti-sifting polygonal carton has been described. The anti-sifting polygonal carton is uniquely capable of storing granulated product in talk stacks with minimal sifting of the product out of the carton. The anti-sifting polygonal carton and its various components may be manufactured from many materials including but not limited to paperboard, cardboard, chip board, polymers, high density polyethylene, polypropylene, polyethylene terephalate ethylene, polystyrene, nylon, ferrous and non-ferrous metal foils, their alloys, and composites.

The phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. Therefore, the claims include such equivalent constructions insofar as they do not depart from the spirit and the scope of the present invention.

We claim:

1. A polygonal shaped carton formed from a single blank comprising:

a front panel;

a rear panel spaced apart and parallel to said front panel;

two or more parallel and spaced apart side panels generally perpendicular to said front panel;

two or more miter panels contiguous with said side panels, said front panel, and said rear panel and said rear panels;

a miter tab to secure said rear panel to one of said side panels;

a bottom formed from a first major lower flap, a second major lower flap, a first minor lower flap, a second minor lower flap and at least two or more lower miter flaps, wherein a first lower miter flap of said two or more lower miter flaps is foldably connected to a first miter panel of the two or more miter panels, a second lower miter flap of said two or more lower miter flaps is foldably connected to a second miter panel of the two or more miter panels;

a top opposite said bottom, said top being formed from a first major upper flap, a second major upper flap, a first minor upper flap, a second minor upper flap and at least two or more upper miter flaps, wherein a first upper miter flap of said two or more upper miter flaps is foldably connected to the first miter panel, a second upper miter flap of said two or more upper miter flaps is foldably connected to the second miter panel;

a tear strip extending entirely across said second major upper flap; and one or more parallel cuts in said second major upper flap, said one or more parallel cuts extending substantially perpendicular to said tear strip from said tear strip to a fold line connecting said second major upper flap to one of said front panel;

whereby said front panel, said rear panel, said miter panels, said miter tab and said bottom form a polyhedron that receives granulated or powdered product and said top seals said carton.

2. The carton of claim 1 further comprising:

one or more adhesive patches upon the reverse face of said blank, said pieces spanning said miter flaps and adjacent flaps.

3. The carton of claim 2 wherein said adhesive patches are generally arranged symmetrically.

4. The carton of claim 1 further comprising:

said lower and upper miter flaps having a generally triangular shape and an emboss pad raised from the reverse face of said blank;

whereby said carton has said bottom sealed by folding said two or more lower miter flaps beneath said first and second minor lower flaps, then folding said first and second minor lower flaps beneath said first and second major lower flaps, and then folding said first major lower flap beneath said second major lower flap; and whereby then said carton has said top sealed by folding said two or more upper miter flaps beneath said first and second minor upper flaps, then folding said first and second minor upper flaps beneath said first and second major upper flaps, and then folding said first major upper flap beneath said second major upper flap.

5. The carton of claim 4 wherein said carton has a generally octagonal shape.

6. The carton of claim 4 wherein said first minor upper flap, said first minor lower flap, said second minor upper flap, said second minor lower flap, said first major upper flap, said first major lower flap, said second major upper flap, said second major lower flap, and said miter tab have adhesive applied to seal said carton upon folding.

7. The carton of claim 1 further comprising:

one or more parallel cuts extending in said first major upper flap perpendicular to the length of said first major upper flap.

8. The carton of claim 1 wherein said second major upper flap has a centered tab and said first major upper flap has a centered notch whereby removal of said tear strip releases said tab, and said tab and said notch interlock to releasably seal said top.

9. A polygonal shaped carton formed from a single blank comprising:

a front panel and an opposite and spaced apart rear panel;

two or more parallel and spaced apart side panels generally perpendicular to said front panel;

two or more miter panels contiguous with said side panels, said front panel, and said rear panel;

a miter tab to secure said rear panel to one of said side panels;

a bottom and an opposite top, wherein said top comprises a first major flap foldably connected to said rear panel at a fold line, a second major flap foldably connected to said front panel at said fold line and overlapping said first major flap, a first minor flap foldably connected to a first side panel of said two or more parallel and spaced apart side panels, a second minor flap foldably connected to a second side panel of said two or more parallel and spaced apart side panels, a tear strip extending across said second major flap, a pair of first cuts extending in said first major flap perpendicularly to said fold line, said first cuts intersecting a marginal edge of said first major flap and said fold line, and a pair of second cuts extending in said second major flap perpendicularly to said tear strip and said fold line, said first cuts intersecting said tear strip and said fold line;

whereby said front panel, said rear panel, said miter panels, said miter tab and said bottom form upon specialized machinery into a polygon with three or more corners that receives granulated or powdered product and then said top seals upon said carton.

10. The carton of claim 9 further comprising:

said corners having triangular miter flaps, said first and second minor flaps having emboss pads, and reinforcing tape on the reverse face of said corners;

whereby said miter flaps fold inwards of said carton, said first and second minor flaps fold upon said miter flaps, and said first and second major flaps fold upon said first and second minor flaps thus sealing said carton.

11. The carton of claim 10, wherein:

said tear strip extends lengthwise; and the top includes an interlocking tab and notch.

12. A blank for forming a polygonal shaped carton, the blank comprising:

a first miter panel connected along a first fold line to a first side panel;

a second miter panel connected along a second fold line to the first side panel;

a first major panel connected along a third fold line to the second miter panel;

a third miter panel connected along a fourth fold line to the first major panel;

a second side panel connected along a fifth fold line to the third miter panel;

a fourth miter panel connected along a sixth fold line to the second side panel;

a second major panel connected along a seventh fold line to the fourth miter panel;

a first miter panel end flap connected to the first miter panel along a first transverse fold line;

a first side panel end flap connected to the first side panel along the first transverse fold line;

a second miter panel end flap connected to the second miter panel along the first transverse fold line;

a first major panel end flap connected to the first major end panel along the first transverse fold line;

a third miter panel end flap connected to the third miter panel along the first transverse fold line;

a second side panel end flap connected to the second side panel along the first transverse fold line;

a fourth miter panel end flap connected to the fourth miter panel along the first transverse fold line;

a second major panel end flap connected to the second major panel along the first transverse fold line;

a tear strip extending across the first major panel end flap;

a first cut and a second cut that extend in the first major panel end flap from the first transverse fold line to the tear strip, with the first cut and the second cut extending substantially parallel each other to form a first dispensing flap; and at least one end flap connected to either the first miter panel, first side panel, second miter panel, first major panel, third miter panel, second side panel, fourth miter panel, or second major panel along a second transverse fold line.

13. The blank of claim 12 further including an adhesive flap connected to the second major panel along an eighth fold line.

14. The blank of claim 12 wherein the first fold line, second fold line, third fold line, fourth fold line, fifth fold line, sixth fold line, seventh fold line, and eighth fold line are substantially parallel.

15. The blank of claim 12 wherein the first miter panel end flap, second miter panel end flap, third miter panel end flap, and fourth miter panel end flap are substantially triangular.

16. The blank of claim 15 wherein adhesive is applied in a substantially triangular pattern to at least a portion of the first miter panel end flap, second miter panel end flap, third miter panel end flap, or fourth miter panel end flap.

17. The blank of claim 15 wherein adhesive is applied in a substantially triangular pattern to at least a portion of the first miter panel end flap, second miter panel end flap, third miter panel end flap, and fourth miter panel end flap.

18. The blank of claim 12 wherein the tear strip includes two ear portions therealong that form a male tab therebetween.

19. The blank of claim 18 wherein the second major panel end flap includes a female notch portion sized to receive the male tab when the blank is formed into the carton.

20. The blank of claim 12 wherein the second major panel end flap includes a third cut and a fourth cut that extend from the first transverse fold line to a peripheral portion of the second major panel end flap, with the third cut and the fourth cut extending substantially parallel each other to form a second dispensing flap.

21. The blank of claim 20 wherein the first dispensing flap and the second dispensing flap are capable of being hinged about the first transverse fold line.

* * * * *